United States Patent [19]

Stringfellow

[11] Patent Number: 4,827,818

[45] Date of Patent: May 9, 1989

[54] PORTABLE ROOFING FELT SLITTER

[76] Inventor: Billy Joe Stringfellow, Rte. 2, Fordyce, Ark. 71742

[21] Appl. No.: 130,951

[22] Filed: Dec. 10, 1987

[51] Int. Cl.[4] ..... B26D 1/30; B26D 7/26

[52] U.S. Cl. ..... 83/440.2; 83/444; 83/564; 83/589; 83/649; 83/858; 83/920; 242/56.2

[58] Field of Search ..... 83/440, 440.2, 425.4, 83/425, 477.2, 444, 564, 578, 589, 856, 858, 920, 649, 585, 407; 242/56.2, 56.3

[56] References Cited

U.S. PATENT DOCUMENTS

| | | | |
|---|---|---|---|
| 959,342 | 5/1910 | Hoke | 83/589 |
| 1,894,379 | 1/1933 | Link | 83/585 |
| 2,143,826 | 1/1939 | Davis | 83/589 |
| 2,710,060 | 6/1955 | Birkmann | 83/649 |
| 2,766,823 | 10/1956 | Purmal | 83/589 |
| 2,780,286 | 2/1957 | Sharpe | 83/649 |
| 2,837,155 | 6/1958 | Lundiff et al. | 83/425 |
| 3,063,322 | 11/1962 | Thomas | 83/589 |
| 3,361,021 | 1/1968 | Toth | 83/649 |
| 3,971,279 | 7/1976 | Wright | 83/649 |

FOREIGN PATENT DOCUMENTS

| | | | |
|---|---|---|---|
| 2190897A | 12/1987 | United Kingdom | 83/856 |

*Primary Examiner*—Frank T. Yost
*Assistant Examiner*—Scott A. Smith
*Attorney, Agent, or Firm*—Stephen D. Carver

[57] ABSTRACT

A compact, portable cutter device adapted to slit rolls of roofing felt into two or more webs of selective widths for application to a commercial roof. A rigid, box-like external housing is adapted to be supported upon a roof surface near the area where the felt is to be laid. An elongated axle transverses the housing to rotatably secure the roll of roofing felt for cutting. A trough-like cradle is defined within the housing beneath the axle to contain the felt roll. The width of the cradle may be varied by manipulation of suitable end tabs to properly center felt rolls of differing widths. The cradle includes a corrosion-resistant surface to facilitate smooth feeding of the felt fabric from the roll. A rigid, slotted cutter plate defines an interface zone where the cutting assembly is brought into contact with the felt fabric. The cutting assembly includes a plurality of adjustably spaced knives semi-permanently, coaxially mounted upon an elongated, rigid header associated with a foot-powered bell crank. A foot pedal defined at the opposing end of the bell crank may be depressed to elevate the header toward the cutter plate, forcing the knives to penetrate and slit the felt fabric passing across the interface zone. When the foot plate is released, the header is lowered so that the knife blades are positioned completely within the housing beneath the interface zone. The felt fabric is urged into optimum position for cutting by a plurality of rigid fabric guides. An integral header access door and an integral shield are associated with the front of the housing for safety. An integral storage case is provided for convenient storage of replacement knife blades or similar articles.

12 Claims, 3 Drawing Sheets

PORTABLE ROOFING FELT SLITTER

BACKGROUND OF THE INVENTION

The present invention relates generally to felt cutting machines adapted to be used by skilled roofers, repairmen, or the like for cutting widths of roofing felt from a roll. More specifically, the present device relates to a portable roll-supporting carriage which houses a plurality of cutting blades for slitting selective widths of roofing felt to be applied to a commercial "built-up" roof surface. The device is suitable for cutting webs of modified bitumen felts, combination base flashing material, mineral surface cap sheet, and similar standard roofing felt rolls of standard American and Metric widths. The invention is believed most appropriately classified in U.S. utility Class 83.

As will be appreciated by those skilled in the art of roofing construction and repair, roofing felts designed for commercial applications are typically made of a modified bitumen fabric and are conventionally employed for "built-up" flat roofs layered with asphalt. The felt fabric is typically stored on large rolls to facilitate transport and use at the roofing site. A single roll of the felt fabric may range from one to one-half meter wide (thirty-nine to fifty-nine inches) and usually contains roughly one hundred yards of felt. The roofing felt is normally covered with a water- and fire-resistant coating, which provides a stiff, smooth surface. However, the quality and texture of the roofing felt varies greatly among different brands and types of felt available on the market.

The skilled roofer will out the roofing felt into strips. The webs of felt are normally overlapped in staggering, brickwork fashion and "mopped" with a hot asphalt mixture. A typical commercial application requires that several plies of felt be laid over the base layer, which is commonly known as the "starter felt". The width of the starter felt webs is typically one-half the width of a roll of felt. Each subsequent ply may range from eight to twenty-four inches wide, depending on the dimensions of the roof surface.

In the past, a variety of devices have been employed to facilitate longitudinal slitting of roofing felt. Typical prior art felt slitters known to me comprise a rectangular stand supported at a distance from the roof surface upon a multiplicity of rigid, elongated legs. A roll-supporting framework transversing the frame may be manually cranked or motor-powered to control the speed and tension of the felt fabric being cut. One or more cutting blades are installed upon a mounting bridge and adapted to penetrate the felt fabric as it is fed through the device. The blades are typically spaced at regular, fixed intervals upon the bridge to provide cuts of standard widths.

Several prior art felt slitters known to me are currently marketed by various roofing supply distributors. For example, a 1984 publication by Reeves Roofing Equipment Company, San Antonio, Tex., discloses cutter devices known as "Reddi Felt Slitters". One Reddi model was hand-powered and the other motor-powered. Either model was available with a thirty-six or sixty-inch roll carrier. Blackwell Burner Co. advertised the same motor-powered product in its 1986 equipment catalog no. RC-22. More recently, a 1987 catalog produced by Roofmaster, Inc. disclosed a similar forty-inch motor-driven felt slitter device, identified by Model No. 24-5000.

The main disadvantage of the prior art devices is their large size and weight. In order to be positioned upon a roof surface, the prior devices must normally be partially dismantled and hoist from the ground by a rope, crane, or the like. The felt rolls must be removed and carried separately to the roof. Moreover, it is often difficult to locate such prior art devices near the work area, since a smooth roofing surface is required to maintain all four legs level during operation. It would thus seem desirable to provide a roofing felt slitter which is compact and lightweight to facilitate easy transport to the roof and from place to place upon the roof surface.

Additionally, the prior art felt slitting devices known to me are biased to grippingly engage the felt roll and to automatically retract after a cut. The particular feature is undesirable, since it will often retract when the worker inadvertently reduces pressure on the fabric and produces an undesired tear. Unnecessary waste of felt fabric results. Moreover, such tension hinders passage of the felt fabric across the blades unnecessarily. A felt slitter device which permits the free flow of fabric from the roll and thus reduces felt waste would be desired.

These prior art felt slitters generally are not adapted to receive oversized rolls of felt fabric or properly adjust for varying widths and textures of felt. Thus it would seem desirable to provide a felt slitter machine which may be readily adjusted to accommodate rolls of varying sizes and textures.

Finally, many of the prior art devices known to me include multiple cutting blades spaced apart at fixed distances. These devices do not permit easy adjustment of the blades to selectively vary the width of the felt web. Hence it is desirable to provide a cutter with adjustably or removably mounted blades which could be selectively moved to produce webs of different widths.

Use of the prior art slitters has also occasioned numerous injuries. The enforcement of stricter safety standards for workers has recently inspired producers of prior art slitters to provide various types of retrofitting safety shields to cover the blades. The prior art shields, however, are typically extremely bulky and inconvenient and tend to make the felt cutter devices even more cumbersome and difficult to transport. If fitted incorrectly, such shields will catch the felt fabric as it feeds through the machine and shred off pieces or completely tear the felt fabric. It is thus desirable to provide integral safety mechanisms which do not interfere with the efficient operation of the cutter.

Certain related cutter devices have been disclosed in the prior art. Prior art patents known to me which may be of some relevance to the present invention include the following: McPhail, U.S. Pat. No. 4,175,460, issued Nov. 27, 1979; U.S. Pat. No. 4,105,791, issued to Price on Apr. 5, 1977; Pickler, U.S. Pat. No. 3,890,868, issued June 24, 1975; and, U.S. Pat. 4,431,141, issued to Schutz on Feb. 14, 1984.

SUMMARY OF THE INVENTION

The present invention comprises a portable cutter device adapted to be used by roofers for slitting rolls of roofing felt and similar materials into two or more webs of selective widths for application to a roof surface. Perhaps the most advantageous feature of the invention is its compact framework, which permits a roofer to easily transport the device and position it for operation near the work area on the roof surface.

The device preferably comprises a rigid, box-like housing adapted to support an elongated, transverse axle for suspending a roll of roofing felt for cutting The roll-supporting axle preferably includes a pair of integral handle grips to facilitate convenient transport of the device. A generally trough-like cradle is defined within the interior of the housing beneath the axle to support and guide the roll of roofing felt.

Preferably the side panels of the cradle comprise corrosion-resistant surfaces preferably made of a material such as TEFLON-brand plastic or the like. The slick surface of the wall facilitates smooth gliding of the felt fabric from the cradle as it unrolls. Thus the device is equipped to process felts of varying texture and stiffness.

The cutting assembly preferably comprises a plurality of knives semi-permanently, adjustably mounted upon an elongated, rigid header. The knives preferably comprise sharpened blades movably mounted upon mounting clamps adapted to slidably mount to the header. The knife mounting clamps are preferably adapted to slide coaxially along the header to permit selective variation of the width of the felt webs to be cut. Eye screws semi-permanently secure the mounting rings in the desired position upon the header. The header preferably is integral with a foot-powered bell crank pivotally mounted for rotation within the housing. A foot plate is provided on the opposing side of the bell crank to permit the operator to engage the cutter by pressing the pedal with his foot while holding the felt fabric with his hands. A rigid, slotted cutter plate defines an interface zone in which the cutting assembly is brought into contact with the felt fabric to be cut.

When the foot plate is in its first position, the knife blades are positioned completely within the housing well beneath the slotted cutter plate in a normally inaccessible position. As the foot plate is depressed toward its second position, the header at the opposing end of the bell crank assembly is elevated toward the cutter plate. When the pedal is fully depressed, the knife blades extend upwardly into the interface zone defined by the cutter plate, and are urged into contact with the felt fabric. A flexible spring attached to the foot plate is adapted to automatically retract the pedal to its first position, so that the cutting knives are safely enclosed within the housing after the cutting operation is completed.

As the roofers manually pull the felt fabric through the housing, the fabric is pulled against the sharpened edge of the blades to effectuate a slit. The felt fabric is maintained in optimum position for cutting by a plurality of rigid, elongated fabric guides. Adjustably mounted tab means are provided for varying the width of the feed path to accommodate rolls of felt of different widths.

Preferably an integral safety shield is pivotally mounted upon the front of the housing. The shield is adapted to cover the interface zone to prevent roofers from inadvertently contacting the knife blades during the cutting operation.

Access to the header to adjust the position of the knife mountings is facilitated by a pivotally mounted door associated with the front of the cutter device. The rigid door is preferably hinged to conveniently open downwardly and rest against the supporting surface. A pair of safety latches maintains the door securely in closed position during use. Replacement knife blades or other tools and accessories may be conveniently stored in a storage pocket integrally mounted upon the interior plane of the door.

Thus it is a fundamental object of the present invention to provide a roofing felt slitter assembly which is compact and easily transportable to the roofing cite.

A similar fundamental object is to provide a felt slitter assembly which includes means for manual adjustment of the cutter blades for selective variation of cutting width.

Another basic object of the present invention is to provide a felt slitter assembly which is adapted to receive felt fabric rolls of varying widths and textures.

Yet another fundamental object of the present invention is to provide a felt slitter device which is suitable for cutting modified bitumen, combination base flashing material, mineral surface cap sheet, and other standard roofing materials.

A further object of the present invention is to provide a felt slitter of the nature described which is adapted to slit felt rolls of both American and Metric widths.

Another object of the present invention is to provide a felt slitter assembly which may be conveniently placed upon the surface of the roof near the working area.

Yet another object of the present invention is to provide a felt slitter assembly of the character described which facilitates free flow of the felt fabric across the cutter blades.

A further object of the present invention is to provide a felt slitter assembly of the nature described which includes a plurality of interacting safety mechanisms to prevent injury to workers resulting from inadvertent contact with the knife blades during operation.

A similar object of the present invention is to provide a felt slitter device of the character described which includes an improved roller mechanism for facilitating processing of felt fabrics of varying texture and stiffness.

Another object of the present invention is to provide a felt slitter device which may be safely manually operated by one or more unskilled roofing workers.

Still another object of the present invention is to provide a felt slitter device which reduces unnecessary waste of fabric.

A further object of the present invention is to provide a felt slitter device of the nature described which can be easily carried by a worker with the roll of felt fabric installed.

Yet another object of the present invention is to provide a felt slitter which is adapted for safe and convenient use under varying weather conditions.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
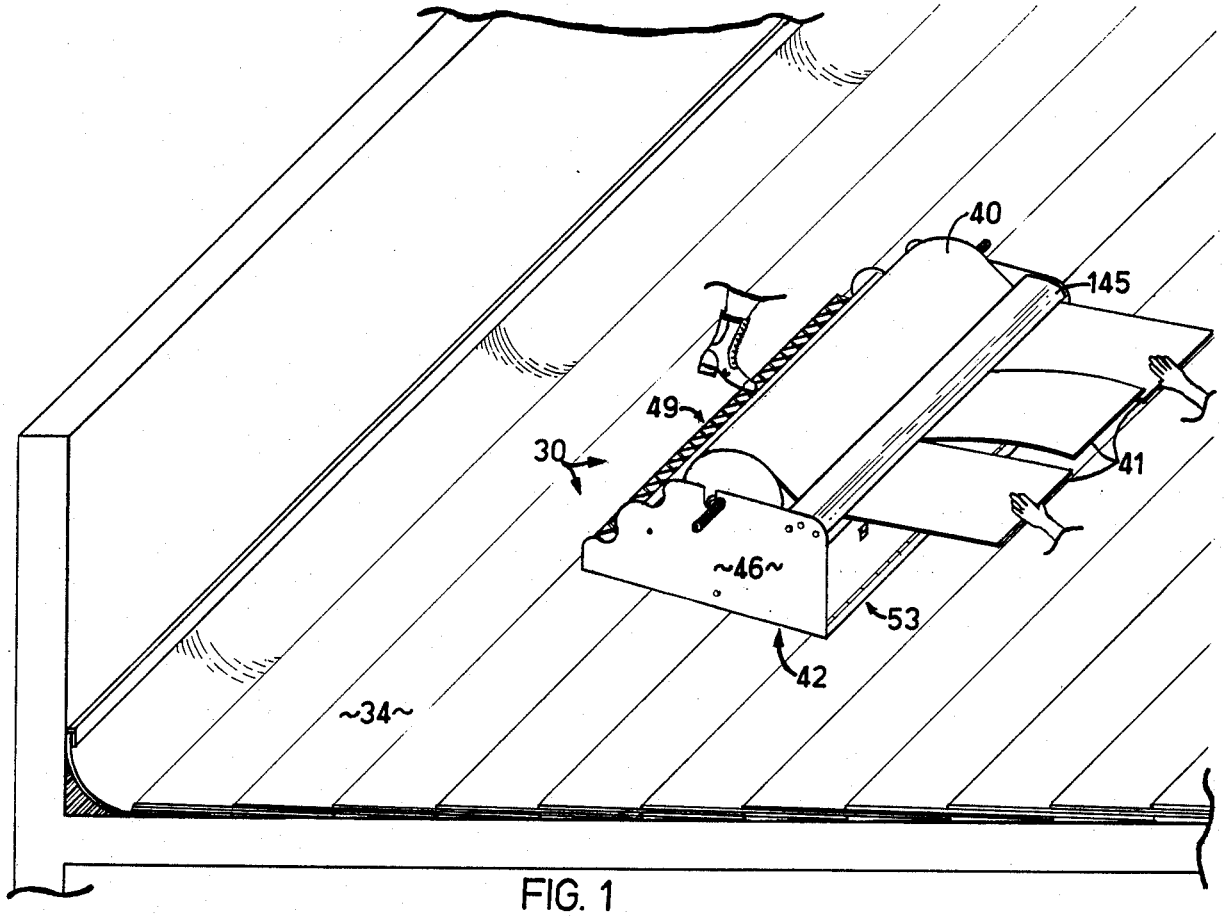
FIG. 1 is a fragmentary, environmental pictorial view illustrating the best mode of my new PORTABLE ROOFING FELT SLITTER in use.

With reference to the appended drawings, the felt cutter device of the present invention, broadly designated by the reference numeral 30, is illustrated in FIG. 1 in position upon a commercial "built up" roofing surface 34. The device 30 is adapted to be used by roofers to slit a roll of roofing felt 40 into two or more webs 41 of selective widths for application with hot asphalt to a roofing surface 34. The felt fabric is slit as it is manually pulled from roll 40 along the defined feed path and slidably urged into contact with the plurality of sharpened cutting blades.

The device 30 comprises a rigid, generally rectangular, box-like outer housing 42 including a pair of opposing rigid side walls 46, an open rear access portion 49, and a front face 53. An elongated, rigid axle 58 is adapted to extend across the housing 42 to suspend a roll of roofing felt 40 in position between walls 46 for cutting. Axle 58 includes a pair of integral hand grips 60 to facilitate convenient transport of the device by roofers between working sites. A rigid cradle 62 is defined internally within housing 42 adjacent axle 58 to maintain roll 40 in alignment for cutting. Cradle 62 comprises a pair of opposing walls made of a friction-resistant material, a planar bottom extending between the side walls, and a plurality of feed rollers which penetrate the planar bottom to facilitate smooth feed of the felt fabric from roll 40.

The cutting apparatus, broadly designated by the reference numeral 68, comprises an elongated header 75 operatively associated with a rear foot pedal 85. As described in detail in the following paragraphs, the cutting apparatus 68 is pivotally mounted for rotation within housing 42 between a first and a second position by manipulation of pedal 85. The cutting apparatus 68 comprises an elongated header 75 adapted to operatively support a multiplicity of cutting knife assemblies 80. A rigid, generally planar, slotted cutter plate 96 defines an interface zone where the knife assemblies 80 are urged into contact with the felt fabric for slitting.

Figure 2:
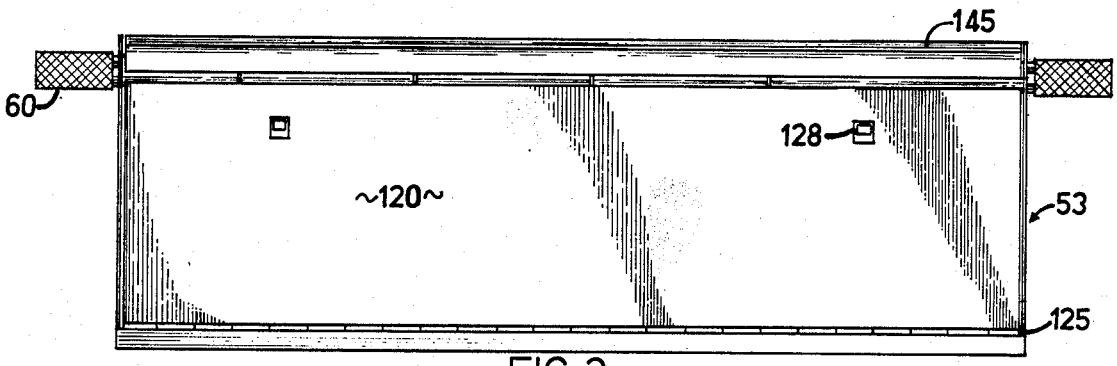
FIG. 2 is a front elevational view with the felt roll omitted.
Figure 3:
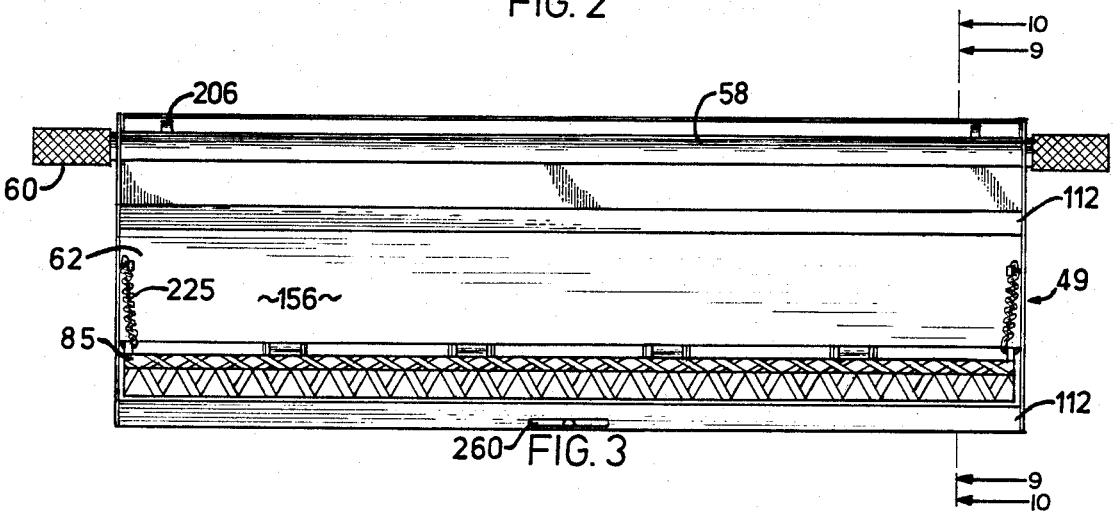
FIG. 3 is a rear elevational view thereof.
Figure 4:
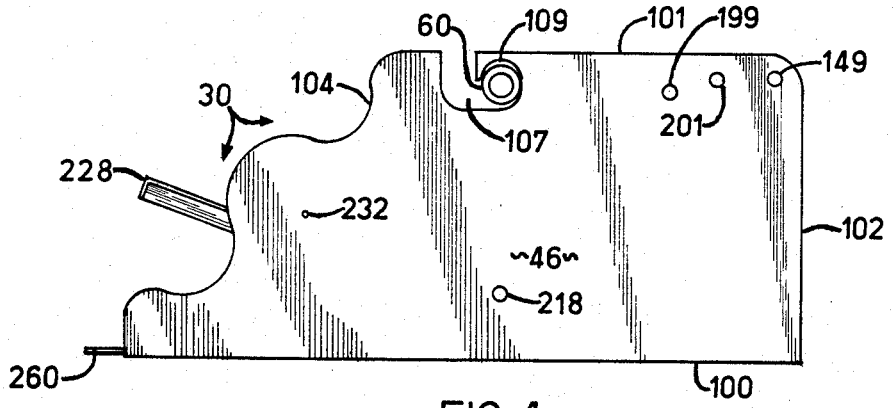
FIG. 4 is a side elevational view thereof.

With additional reference now directed to FIGS. 2–4, the preferred housing 42 comprises an outer housing of generally box-like configuration preferably made of a rigid, weather-resistant material such as aluminum or the like. In the preferred mode, side walls 46 each comprise a generally flat bottom 100, an opposing top 101, a generally rectangular front portion 102, and an opposing rear portion 104 of irregular, curved configuration. A channel 107 of generally L-shaped configuration is defined within each of side walls 46. Channel 107 extends vertically downwardly from top 101 and then horizontally toward front portion 102, and terminates in a rounded eyelet 109 adapted to receive and firmly lock axle 58 into position between walls 46. When locked into position, axle 58 is centered above cradle 62 and defines the center of balance for housing 42, so that the device 30 is retained in a stable, balanced condition.

Side walls 46 are maintained in stable, generally parallel, spaced-apart relation by a plurality of rigid cross-pieces 112 permanently anchored at each end by means of a weld or the like to walls 46.

Rear access 49 and front face 53 of housing 42 are open planes defined between side walls 46. The bottom 114 of housing 42 also defines an open plane extending between side walls 46. The open structure of housing 42 facilitates user access to the interior working parts of device 30 for maintenance or repair and results in a lightweight, easily portable framework. The open bottom 114 additionally serves to define a drainage path through which rainwater, fabric scraps, and other similar materials are released from the interior of the housing and not permitted to damage the device or otherwise interfere with the smooth operation thereof.

Figure 11:
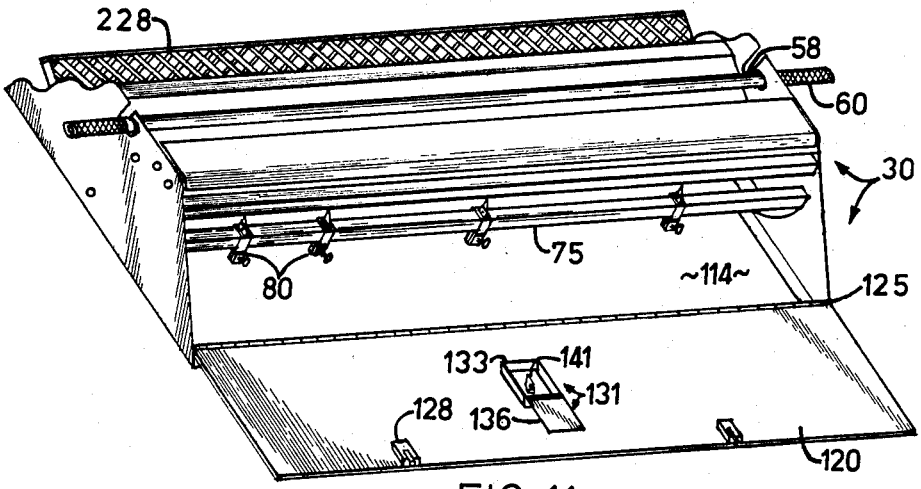

As best viewed in FIG. 11, front face 53 is covered by a rigid, generally rectangular access door 120, which is adapted to be pivotally mounted upon an elongated hinge 125 for rotation between its first, closed position as illustrated in FIGS. 1–4, and its second, open position (FIG. 11). Hinge 125 is permanently attached at its ends to side walls 46. In its open position, door 120 is adapted to rest horizontally upon roof surface 34, conveniently out of the way so that the roofer may conveniently access the knife assemblies 80 upon header 75 for adjustment as described in detail below. A pair of integral safety latches 128 associated with door 120 lock the door in its closed position during operation.

Access door 120 also includes an integral storage box 131 comprising a generally rectangular casing 133 and a pivotally mounted, locking cover flap 136. Box 131 facilitates convenient storage of replacement knife blades 141, tools, or other supplies typically needed for roofing work.

A rigid, elongated safety shield 145 operatively associated with front face 53 is permanently, pivotally mounted upon an elongated dowel 149 which transverses the width of housing 42 and penetrates side walls 46. As best viewed in FIGS. 9 and 10, shield 145 is adapted to pivot between its first, closed position A and a second, open position B (illustrated in broken lines). Shield 145 is adapted to be opened to facilitate loading of the felt 40 into the device, as viewed in FIG. 9. In its closed position, shield 145 is operative to assist feed of felt 40 through device 30 as described in detail below, and protects roofers from inadvertent contact with knife assemblies 80 during operation.

Figure 5:
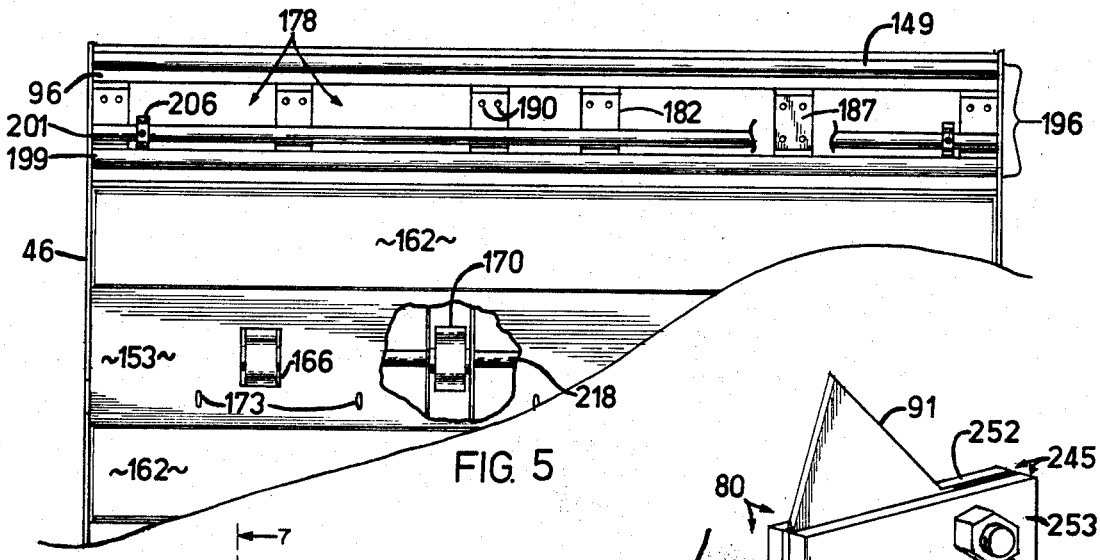
FIG. 5 is an enlarged scale, fragmentary top view thereof, with portions thereof broken away for clarity.
Figure 10:
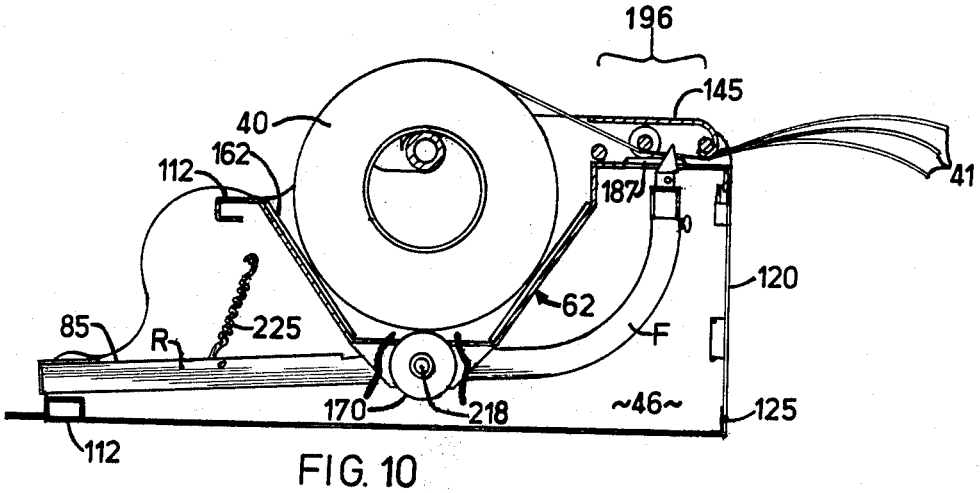
FIG. 10 is a sectional view similar to FIG. 9, illustrating the rocker assembly in its second, operative position, portions thereof being broken away for purposes of clarity; and, FIG. 11 is an oblique top view thereof, illustrating the preferred access door in an open position.

With reference to FIGS. 5 and 10, a rigid cradle 62 of generally U-shaped configuration is centrally defined within housing 42 between walls 46. Cradle 62 comprises a generally planar base 153 and a pair of rigid panels 156. Each of panels 156 includes an integral, planar lining 162 of a friction-resistant material such as polished TEFLON-brand polymers or the like. Panels 156 are permanently anchored by means of a weld or the like upon walls 46. Elongated orifices 166 are defined through base 153 for operatively receiving rotatably mounted feed rollers 170 (FIG. 10), which are adapted to engage roll 40 and assist the feed of felt through cradle 62, as described in detail in the operational paragraphs which follow. A multiplicity of weepholes 173 are also defined through base 153 for improved drainage.

Figure 9:
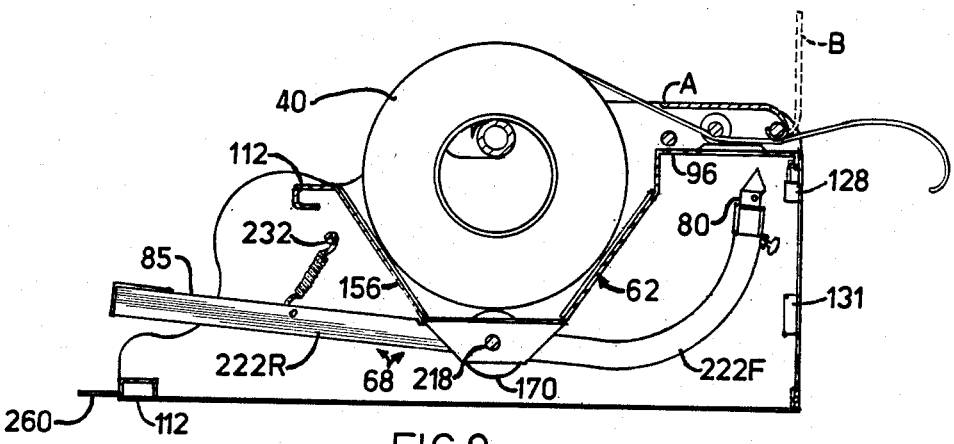
FIG. 9 is a sectional view thereof taken generally along line 9—9 of FIG. 2, illustrating the rocker assembly in its first, resting position.

With reference now to FIGS. 5, 9, and 10, cradle 62 is integral with the elongated, planar cutter plate 96 associated with front face 53. Cutter plate 96 comprises a generally rectangular, planar bar having a plurality of elongated slots 178 separated by a plurality of rigid, transverse cross braces 182. Rigid, rectangular pads 187 of a friction-resistant material such as TEFLON-brand polymers or the like are adjustably secured to the upper surface of cross braces 182 by screws 190 or the like. By adjustment of screws 190, pads 187 may be slightly raised or lowered relative to cutter plate 96 to narrow or widen the felt feed path. Thus the device 30 is adapted to smoothly process rolls of roofing felt of different texture and density.

As described in detail in the operational paragraphs which follow, cutter plate 96 defines an interface zone, designated by the reference numeral 196, which is adapted to receive and position the felt for uniform cutting. The felt fabric is urged into position for cutting by a pair of elongated, rigid, cylindrical fabric feed guides 199, 201 which extend across the width of housing 42 and are permanently anchored upon side walls 46 by means of welding or the like. Feed guide 199 is positioned generally at the rear edge of cutter plate 96. Feed guide 201 is positioned roughly above the longitudinal axis of cutter plate 96.

Figure 6:
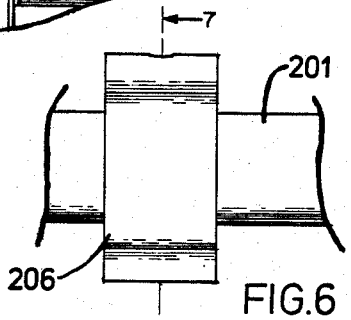
FIG. 6 is an enlarged, fragmentary plan view of a preferred adjustment tab thereof.
Figure 7:
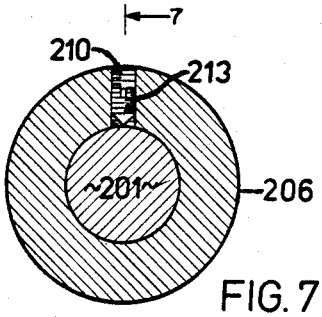
FIG. 7 is an enlarged scale, sectional view, taken generally along line 7—7 of FIG. 6.

A pair of rigid cylindrical guide tabs 206 are coaxially mounted upon feed guide 201. As best viewed in FIGS. 6 and 7, each of tabs 206 comprises a rigid ring having a hollow core and an appropriate tapped bore 210 adapted to receive a countersunk adjustment screw 213. The hollow core is preferably of a diameter only slightly larger than the diameter of guide 201, so that when tab 206 is properly installed, it makes abutting contact with the outer periphery of guide 201. Screw 213 extends through bore 210 to operatively contact guide 201 and thus temporarily, firmly secure tab 206 in the desired selective position. Screw 213 may be manually loosened to permit coaxial movement of tab 206 along the length of guide 206 to vary the width of the fabric feed path defined above cutter plate 96. Thus the device 30 is adapted to receive and cut roofing felt rolls of different widths, within the operative limits established by side walls 46.

Figure 8:
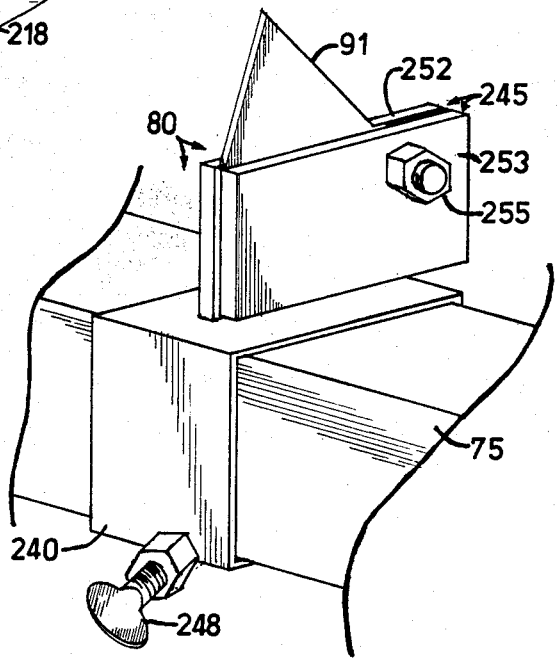
FIG. 8 is an enlarged, fragmentary isometric view of the preferred knife assembly.

With reference directed to FIGS. 8–10, the preferred cutting apparatus 68 comprises a rigid bell crank assembly of roughly rectangular configuration which is adapted to be centrally, pivotally mounted within housing 42. The apparatus 68 comprises an elongated, rigid, knife-supporting header 75 operatively associated with the front face 53 of housing 42 and an elongated, rigid foot pedal 85 operatively associated with the rear access portion 49 thereof. The apparatus 68 is supported upon an elongated rigid rod 288 which is permanently mounted at its ends to side walls 46. Rod 218 is positioned centrally beneath cradle 62 and extends parallel to base 153 of cradle 62 and to axle 58. The rod 218 forms the mutual axis of rotation for cutting apparatus 68 and feed rollers 170, which penetrate base 153 of cradle 62 as previously described.

Header 75 and pedal 85 are maintained in fixed, generally parallel, spaced-apart relation by a pair of identical rigid rocker arms 222. Arms 222 are made preferably of a strong, rigid, shock-resistant material such as channel steel or the like. The rear portion 222R of arm 222 generally defines a straight line, while the front portion 222F defines an upwardly extending curve. Expandable springs 225 are permanently anchored upon the rear portion 222R of each arm 222 and are adapted to extend between arms 222 and a rigid mounting pin 232 associated with the side wall 46. Spring 225 is provided to bias arms 222, so that the cutting assembly 68 automatically returns to its first, resting position when the pedal is released, as described in detail in the operational paragraphs which follow.

Pedal 85 comprises a rigid, generally L-shaped plate 228 of textured or corrugated aluminum adapted to safely, grippingly receive the foot of a roofer. Plate 228 is permanently anchored at each end to arms 222 by means of weld or the like.

With specific reference now directed to FIGS. 8 and 11, header 75 comprises an elongated, rigid shaft associated with the front face 53 of housing 42. The header 75 is adapted to operatively support a plurality of knife assemblies 80 for cutting. Knife assemblies 80 comprise a hollow, cylindrical mounting bracket 240 integrally associated with a blade-supportive clamp 245 and a rigid cutting blade 91. Bracket 240 is adapted to be slidably mounted about header 75 and temporarily secured in a selected position thereon by set screw 248. When screw 248 is loosened, bracket 240 will freely slide lengthwise along header 75. Once the blade assembly is correctly positioned to provide a web 41 of desired width, set screw 248 may be firmly tightened to engage header 75.

Clamp 245 comprises an opposing pair of rigid faces 252, 253 adapted to sandwichably retain sharpened cutting blade 91. Faces 252, 253 are joined by a bolt assembly 255. As bolt assembly 255 is loosened, faces 252, 253 are separated to permit removal of the cutting blade 91. When a replacement blade 141 is properly installed, bolt assembly 255 may be tightened to draw faces 252, 253 into firm, gripping abutment.

Blades 91 are adapted to be installed with the sharpened edge directed rearwardly toward the felt roll 40 and extending upwardly toward the cutter plate 96, as best illustrated in FIGS. 8–10.

OPERATION

With specific reference now to FIGS. 9 and 10, the roll of roofing felt to be slit is first manually loaded into the device. Axle 58 may be manually lifted from channel 107 and removed from housing 42. The axle is then inserted through the hollow core of roofing felt roll 40. Thus positioned upon axle 58, the roll 40 may be lowered into housing 42 and generally centered within the area defined by cradle 68. Axle 58 is then urged into semi-locking engagement with eyelets 109. The roofer may then grasp hand grips 61 and carry the device with the roll installed to the desired working area.

In applications where manual transport of the device is deemed undesirable, the device may be hoist from the ground up to the roof surface by means of a pulley or the like. The cable from the hoist may be secured to the tow handle 260 permanently connected at the rear of housing 42. However, for safety purposes, axle 58 must be completely removed before the device is lifted from the ground, and the axle 58 and felt roll must be transported separately to the working area. Otherwise, if it is left in place, the axle may become dislodged as the device is lifted and fall from the housing.

Once the device is appropriately positioned at the work site with the axle and felt roll installed, the felt fabric should be fed from the top of roll 40 forward through the front face 53 of housing 42. The fabric is teen extended forward toward the interface zone 196. To properly align the felt fabric for cutting, the fabric is first extended and centered above cutter plate 96. Tabs 206 may be manipulated into position as described above to abut the outer edges of the fabric, and define the outer margins of the feed path. The fabric is then threaded between guides 199 and 201 as illustrated in FIG. 9 and beneath the dowel supporting safety shield 145.

For purposes of safety, safety shield 145 is so designed that the fabric cannot be fed through to the front 53 of the device 30 for cutting until the shield 145 is lowered into its closed position A. The fabric may then be manually pulled forward through the interface zone and out the front face 53 of the device 30 by a roofer, as illustrated in FIG. 1.

After the fabric is thus properly loaded and centered within housing 42, the knife assemblies may be positioned to produce webs of the desired width. By manually releasing latches 128, the roofer may pivot door 120 to its open position, allowing it to come to rest on the roofing surface. To set the cutting blades, the roofer must merely loosen set screw 248 to release knife assembly bracket 240 for slidable movement along header 75. The roofer may then place a measuring tape or stick alongside header 75 with its ends aligned with tabs 206 and slide the knife assembly bracket to the appropriate position to produce the desired web width. After positioning the knife assembly correctly, the roofer must firmly tighten the set screw to secure the bracket in operative position. The roofer may then check the condition of knife blade 91 and assure that it is correctly positioned and firmly secured by tightening bolt assembly 255. Once assured that the device is ready for operation, the roofer may close access door 120 and secure the latches.

In its first, resting position illustrated in FIG. 9, the knife assemblies 80 are safely retained within housing 42. Thus, to effectuate a cut, the knife assemblies must be raised into the interface zone 196 defined above cutter plate 96. As best illustrated in FIG. 10, movement of the knife assemblies into cutting position results from the application of downward force applied to foot pedal 85. When pedal 85 is depressed, spring 225 is expanded and rocker arm 222 rotates about the pivot point defined by rod 218, so that by reciprocating motion, the front 222F of the rocker arm is raised upwardly. Accordingly, header 75 is lifted, raising knife assemblies so that the sharpened cutting blades 91 penetrate the slots 178 of the cutter plate to contact the felt fabric.

The felt fabric must be manually pulled through the front of the device. When a new felt roll is initially installed, its bulk and weight may force it downward into contact with the base 153 and side panels 156 of cradle 62. Feed rollers 170 are therefore adapted to contact the lower periphery of the full roll 40 to prevent the roll from resting and slidably contacting the base and side panels. As the felt is pulled from the roll, the roll rotates and rollers 170 are simultaneously activated. As the roll decreases in diameter, no additional assistance is required.

During feeding, the fabric is contained narrowly within the feed path, since its upward motion is limited by contact with the forward edge of safety shield 145 and its downward motion is limited by guide 199. Additionally, tabs 206 prevent side-to-side movement of the felt fabric during cutting, so that webs of uniform width are produced. Thus the fabric is prevented from buckling or wrinkling and will not jam as it feeds through toward face 53. Waste resulting from jammed or torn felt fabric is thus virtually eliminated.

As pulling force is applied, the fabric is tightly retained in a flat position between guide 201 and dowel 149, so that a smooth, uniform cut is accomplished. Individual webs 41 of felt are then lifted out of the front of the housing as best viewed in FIG. 1. The roofer holding the felt may simply lay the felt webs out along the length of the roofing area and manually cut the webs from the roll.

When the cut is complete and the pedal is released, spring 225 automatically retracts to pull the rocker assembly back into its first, resting position so that the knife assemblies are safely positioned within the housing.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A manually operable roofing felt slitter adapted to be used for slitting a roll of roofing felt into webs of selective widths for application to a built-up roof surface, said slitter comprising:

a compact, rigid, box-like frame adapted to be positioned upon said roof surface, said framework comprising: a pair of opposing, planar side walls;

a front wall portion comprising a hingably mounted access door and safety shield means;

rigid framing means for maintaining said walls in stable, parallel, spaced-apart relation;

integral tow means for facilitating hoisting of said slitter to a selected roofing site; and, a removably mounted, elongated, cylindrical roll-supportive axle comprising an elongated rod terminating at each end in integral handle grips;

a trough-like cradle defined internally within said framework to maintain said felt roll in centered position within said framework, said cradle comprising at least one friction-resistant surface;

a rigid, planar, friction-resistant cutter plate having a plurality of longitudinally extending slotted passages, said cutter plate defining a cutting zone;

a multiplicity of selectively positionable cutter knives, each of said cutter knives comprising a rigid cutting blade adapted to be secured within an adjustably mounted bracket whereby the sharpened edge of said blade extends vertically towards said cutter plate;

spring-biased, foot-powered bell crank means for elevating said cutter knives towards said cutter plate and through said felt to effectuate a slit, said crank means comprising:

a rigid header for mounting said cutter knives;
an elongated pedal plate;
a rigid rocker arm adapted to extend between said header and said pedal plate;
an elongated, rigid axle, said axle defining a pivot point for rotation of said crank within said framework; and,
a plurality of feed rollers adapted to be coaxially mounted upon said axle for rotation about said pivot point;
fabric guide means for urging said felt from said roll through said cutting zone, said fabric guide means comprising a plurality of rigid, elongated rods adapted to transverse said framework, at least one of said rods including tab means for selectively adjusting the width of the feed path to accommodate felt rolls of differing widths;
wherein said knives are adapted to be selectively, coaxially positioned in spaced-apart relation along said rigid header to extend vertically toward said cutter plate; and,
whereby when said felt is manually fed through the device, individual webs of selective widths of roofing felt will be concurrently produced.

2. The roofing felt slitter as defined in claim 1 including pivotally mounted, planar front flap means for facilitating access to said header for maintenance purposes, said flap means including integral safety latches and an integral case for storing replacement blades and other accessories.

3. A portable cutter device for use by roofers for slitting roofing felt into two or more webs of selective widths, said cutter device comprising:
rigid enclosure means for rotatably supporting a roll of roofing felt to be cut, said enclosure means adapted to be disposed upon a suitable supporting surface adjacent to the roof area to be repaired;
trough-like cradle means defined within said enclosure means for centering felt rolls to be cut;
rotatable roller means contacting said cradle means for facilitating smooth feed of said felt from said roll;
rigid, generally planar, slotted cutter plate means for receiving and supporting said felt to be cut;
friction-resistant feeder means associated with said cutter plate means for facilitating smooth feed of said felt from said cradle means past said cutter plate means;
felt axle means for rotatably mounting said roll within said enclosure means proximate said cradle means;
slitter means for slitting said roofing felt, said slitter means comprising an elongated, rigid header disposed within said enclosure and a plurality of spaced-apart knife assemblies associated with said header adapted to cut said roofing felt, said knife assemblies each comprising a cutting blade normally extending toward said cutter plate and adapted to be secured at a desired position along said header to permit variation of web width;
foot-operated means for selectively actuating said slitter means by elevating said header to thrust said knife assemblies through slots in said cutter plate and through said felt, said last mentioned means comprising:
an elongated, rigid foot plate;
a spring-biased crank assembly journalled for relative rotation within said enclosure means for operatively coupling said foot plate to said header; and,
rod means for mounting said crank assembly and establishing the rotational axis of said crank assembly and said roller means;
guide means for urging said felt into position for contracting said slitter means, said guide means comprising a plurality of transversely extending, elongated, parallel rigid rods, at least one of said rods positioned above said felt to urge it towards said cutter plate; and,
whereby, as said felt is manually unrolled from the cutter device, individual selectively sized webs will be concurrently outputted by said cutter device.

4. The cutter device as defined in claim 3 wherein said roller means are rotatably captivated upon said rod means.

5. The portable cutter device as defined in claim 3 wherein said enclosure means comprises:
integral shield means for covering said guide means to prevent roofers from inadvertently contacting said slitter means;
pivotally mounted front flap means for facilitating roofer access to said header means for adjustment and maintenance of said knife assemblies, said front flap means including integral case means for storing spare cutting blades or similar devices; and
integral tow means for receiving a rope handle, or similar article to facilitate transport of the cutter device to the selected roofing site.

6. A compact roofing felt slitter adapted to be conveniently positioned upon a suitable surface at a roofing repair site for slitting a roll of roofing felt into one or more webs of desired widths, said slitter comprising:
a rigid, box-like housing adapted to be disposed upon a generally planar supporting surface;
rigid felt axle means associated with said housing for operatively, rotatably suspending said roll of roofing felt for cutting;
internally disposed cradle means for containing said roofing felt roll in position for cutting;
a plurality of knife assemblies for slitting felt, said knife assemblies comprising a cutting blade, slidable blade-controlling mounting means, and means for securing said mounting means at a desired position to facilitate cutting of felt webs of desired widths;
a rigid, generally planar, slotted cutter plate adapted to define an interface zone where said knife assemblies contact said felt to effectuate a cut;
rocker assembly means journalled for rotation within said housing for moving said knife assemblies into said interface zone, said rocker assembly means comprising:
rigid header means disposed within said housing means for controlling said knife assemblies;
foot pedal means for pivoting said header means toward said interface zone; and,
rigid, elongated rod means for pivotally mounting said rocker assembly means within said housing;
fabric guide means for facilitating smooth passage of said felt from said roll across said interface zone, said fabric guide means comprisisng:
a plurality of transversely extending, elongated, parallel rods for guiding discharge of said felt, at least one of said rods positioned above said felt to urge it towards said interface zone;

as plurality of rigid, friction-resistant pads associated with said cutter plate means;

feed roller means for facilitating the smooth feed of felt from said roll out of said cradle; and, manually adjustable tab means for maintaining the felt fabric properly centered above said interface zone to assure cuts of uniform width;

whereby, as said felt is manually unrolled from the cutter device, individual selectively-sized webs will be concurrently produced and outputted by said slitter.

7. The roofing felt slitter as defined in claim 6 wherein said felt axle means comprises a rigid, elongated cylinder and a pair of integral, coaxial hand grips adapted to extend beyond said housing to facilitate convenient transport.

8. The roofing felt slitter as defined in claim 7 wherein said housing includes safety means, said safety means comprising:

eyelet means for locking said felt axle means into position within said housing;

integral shield means for covering said cutter plate means to prevent roofers from inadvertently contacting said knife assemblies during operation; and, rigid framing means for maintaining said housing in rigid, stable position upon a selected roofing surface.

9. The roofing felt slitter as defined in claim 8 wherein said feed roller means are adapted to be mounted for rotation upon said rod means in coaxial alignment with said rocker assembly means.

10. The roofing felt slitter as defined in claim 9 wherein said cradle means comprises at least one friction-resistant wall surface for facilitating the smooth feed of felt fabric out of said cradle and into said interface zone and wherein said cradle means is adapted to support said felt roll in centered position relative to said cutter plate.

11. The roofing felt slitter as defined in claim 10 wherein said housing includes pivotally mounted front flap means for facilitating roofer access to said header means for adjustment and maintenance of said knife assemblies, said front flap means including safety latch means and integral storage case means for storing spare cutting blades or similar devices.

12. The roofing felt slitter as defined in claim 10 including integral tow means for receiving a rope, handle, or similar article to facilitate hoisting of the cutter device to a selected roofing site.

* * * * *